US009878891B2

(12) United States Patent
Balzarin et al.

(10) Patent No.: US 9,878,891 B2
(45) Date of Patent: Jan. 30, 2018

(54) MACHINE FOR FILLING CONTAINERS WITH LIQUIDS, AND PROCESS FOR FILLING CONTAINERS, IN PARTICULAR BY MEANS OF SUCH FILLING MACHINE

(71) Applicant: MBF S.p.A., Verona (IT)

(72) Inventors: Franco Balzarin, Verona (IT); Giuliano Boscaro, Verona (IT)

(73) Assignee: MBF S.p.A., Verona (IT)

( * ) Notice: Subject to any disclaimer, the term of this patent is extended or adjusted under 35 U.S.C. 154(b) by 658 days.

(21) Appl. No.: 13/760,700

(22) Filed: Feb. 6, 2013

(65) Prior Publication Data

US 2013/0240081 A1 Sep. 19, 2013

(30) Foreign Application Priority Data

Feb. 7, 2012 (IT) ..... PD2012A0028

(51) Int. Cl.
*B67C 3/20* (2006.01)
*B67C 3/22* (2006.01)
*B67C 3/26* (2006.01)

(52) U.S. Cl.
CPC ..... *B67C 3/225* (2013.01); *B67C 3/2634* (2013.01); *B67C 2003/2602* (2013.01)

(58) Field of Classification Search
CPC ... B67C 3/16; B67C 3/225; B67C 2003/2602; B67C 3/2634
USPC ..... 141/52, 59
See application file for complete search history.

(56) References Cited

U.S. PATENT DOCUMENTS 5,054,527 A * 10/1991 Rozier ..... B24B 53/001 141/147
5,125,440 A 6/1992 Mette
5,501,253 A * 3/1996 Weiss ..... B67C 3/2614 141/198

(Continued)

FOREIGN PATENT DOCUMENTS

EP 0697369 A1 2/1996
EP 2386518 A1 11/2011

(Continued)

*Primary Examiner* — Timothy L Maust
*Assistant Examiner* — Andrew StClair
(74) *Attorney, Agent, or Firm* — Meunier Carlin & Curfman LLC

(57) ABSTRACT

Machine (1) for filling containers with liquids, which comprises a rotatable carousel (10) equipped with a tank (12) for containing a liquid to be bottled, and a plurality of valve groups (13) peripherally mounted on the rotatable carousel (10) and equipped with a supply duct (14) for the flow of said liquid into containers (2) to be filled, and with an air return cannula (16).

Furthermore, each valve group (13) comprises: a collection cup (29), which is connected to the upper end (16") of the air return cannula (16); a first control valve (34), actuatable to place the collection cup (29) in communication with an atmospherically pressurised evacuation circuit (31); a second control valve (35) actuatable to place the collection cup (29) in communication with a suction circuit (33', 33").

Furthermore, a logic control unit (100) operatively connected to the first and second control valves (34, 35) of each valve group (13) is provided in order to control the switch of said control valves (34,35).

5 Claims, 5 Drawing Sheets

(56) References Cited

U.S. PATENT DOCUMENTS

| | | | | | |
|---|---|---|---|---|---|
| 5,634,500 | A * | 6/1997 | Clusserath | B67C 3/10 | 141/44 |
| 6,213,169 | B1 * | 4/2001 | Clusserath | B67C 3/10 | 141/40 |
| 6,457,495 | B1 * | 10/2002 | Meheen | B67C 3/10 | 141/40 |
| 6,463,964 | B2 * | 10/2002 | Clusserath | B67C 3/10 | 141/104 |
| 7,347,231 | B2 | 3/2008 | Schmoll | | |
| 7,353,848 | B2 * | 4/2008 | Krulitsch | B67C 3/06 | 141/146 |
| 7,469,726 | B2 * | 12/2008 | Clusserath | B67C 3/04 | 141/144 |
| 8,776,839 | B2 * | 7/2014 | Clusserath | B67C 3/10 | 141/302 |
| 2002/0023689 | A1 * | 2/2002 | Sindermann | B67C 3/10 | 141/37 |
| 2011/0277881 | A1 * | 11/2011 | Gruber | B67C 3/22 | 141/266 |
| 2014/0283947 | A1 * | 9/2014 | Wagner | B67C 3/10 | 141/6 |

FOREIGN PATENT DOCUMENTS

| | | | | |
|---|---|---|---|---|
| FR | 2464917 | A1 | 3/1981 | |
| WO | 1999003774 | A1 | 1/1999 | |
| WO | WO 2013026522 | A1 * | 2/2013 | B67C 3/02 |

* cited by examiner

MACHINE FOR FILLING CONTAINERS WITH LIQUIDS, AND PROCESS FOR FILLING CONTAINERS, IN PARTICULAR BY MEANS OF SUCH FILLING MACHINE

CROSS-REFERENCE TO RELATED APPLICATIONS

This application claims the benefit of Italian Patent Application No. PD2012A000028, filed on Feb. 7, 2012, the disclosure of which is expressly incorporated herein by reference in its entirety.

FIELD OF APPLICATION

The present invention refers to a machine for filling containers with liquids and a process for filling containers with liquids, particularly by means of said filler machine, according to the preamble of the relative independent claims.

The machine in question is destined for use in industrial bottling systems to fill containers, particularly bottles, with edible liquids, such as wines, spirits, liqueurs, etc.

In more detail, the machine in question is of the rotatable carousel type, equipped with a plurality of filing valve groups, and is preferably used in bottling lines after a rinsing machine and before a capping machine.

STATE OF THE ART

Gravity type filling machines traditionally equipped with a fixed support structure onto which a rotatable carousel is rotatably mounted are known on the market. The latter mounts a cylindrical tank, which contains a liquid to be bottled. In particular, the tank is filled with the liquid to be bottled up to a determined level, above which it is filled with an inert gas (nitrogen for example) kept substantially at atmospheric pressure.

Below the tank is peripherally fastened a plurality of valve groups to channel the liquid contained in the tank inside the containers to be filled below, in particular bottles, resting on corresponding support plates.

Each valve group comprises a supply duct in communication with the tank, and is intercepted by a shutter that regulates the flow of liquid from the tank to the container below.

Inside the supply duct, an air return cannula is mounted, through which, while the container is being filled, the air present in said container is evacuated.

In more detail, the air return cannula is equipped with an open lower end destined to be inserted in the container to be filled, and with an open upper end placed inside the tank to channel into the latter the air coming from the container while it is being filled.

Operatively, the container is hydraulically associated with the corresponding valve group, by means of the lifting of the corresponding support plate, with the mouth of the container which is brought into a sealing relationship with the supply duct of the valve group.

The shutter of the supply duct is therefore open to allow the delivery of the liquid into the container, and the air present in the container is channelled inside the tank through the air return cannula.

When the liquid delivered into the container reaches the lower end of the air return cannula, blocking it, a residual amount of said liquid rises back up the inside of the air return cannula until it reaches the same level as the liquid in the tank according to the known principle of communicating vessels, consequently determining the interruption of the delivery of the liquid into the container.

The main problem with the gravity filling machine briefly described above is due to the fact that the residual amount of liquid, which remains inside the air return cannula while the container is being filled, prevents the passage of air in the next filling cycle. It is necessary, therefore, to wait for said residual amount of liquid to fall back down the air return cannula to start filling the next container, with consequent increase in the time required to fill the container and, therefore, a low production capacity of the filling machine.

Another problem with the gravity filling machine briefly described above is due to the fact that the air evacuated from the container while it is being filled is channelled into the tank, with a consequent contamination of the inert gas atmosphere inside said tank.

Another problem with the gravity filling machine briefly described above is due to the fact that the residual amount of liquid inside the air return cannula partly drips out of the latter before the next container to be filled is associated with the valve group, dirtying the underlying parts of the filling machine.

In order to overcome some of the above-mentioned problems with gravity filling machines, filling machines of the so-called light vacuum type have been introduced onto the market, in which a light vacuum compared with the atmospheric pressure, about 70-80 millibar for example, is created inside the tank.

In this way, when the container has been filled, the vacuum inside the tank determines a suction of the residual amount of liquid remained inside the air return cannula, in order to clean the inside of the latter and prevent the liquid dripping from the cannula.

However, in practice, this last known solution is not without problems of its own.

The main problem with the light vacuum machine briefly described above consists in the fact that it cannot be used to fill plastic containers, particularly in PET, in that the vacuum in the tank determines a continuous suction through the air return cannula, particularly while filling the container. This continuous suction determines a vacuum inside the containers to be filled that is substantially the same as that in the tank (70-80 millibar below atmospheric pressure) which would cause the crushing of the plastic container.

This problem is felt particularly due to the increasing use of plastic containers for bottling edible liquids.

Also known in documents US 2005/0150571 and U.S. Pat. No. 5,125,440 are filling machines in which the air return cannula of all the valve groups is connected, by means of a control valve, to the same ring duct above the tank lid, and connected in turn to a suction circuit to suck the air from the containers while they are being filled and evacuate it outside of the tank.

The main problem with the known filling machines described in documents US 2005/0150571 and U.S. Pat. No. 5,125,440, consists in the fact that they too cannot be used to fill plastic containers, since the suction executed inside the containers would cause their crushing.

Also known are machines for filling containers with liquids of another type, i.e.: the isobaric type for bottling carbonated liquids, in which the inside of the tank is subjected to high pressures (7-8 bar for example) to prevent the degasification of the liquid contained in it.

For example, patent FR 2464917 describes an isobaric filling machine equipped with a collection tank obtained by means of a ring groove on the lid of the tank and connected at the top to the air return cannulae of all the valve groups to receive the air and a residual amount of liquid from the container while the latter is being filled.

Furthermore, the collection tank is equipped with a release valve to evacuate the air from the container while it is being filled, and is connected to the tank by means of a return duct to return the residual amount of liquid from the container inside said tank.

Also this known solution cannot be used to fill plastic containers either, since the filling of the containers provides for taking the inside of the latter to the same high pressure as the tank, which would cause deformation and damage to plastic containers.

Also known are isobaric filling machines in which each valve group is equipped with a first valve, actuatable to connect the air return cannula to a suction circuit to execute a pre-evacuation step of the air in the container, a second valve, actuatable to connect the air return cannula to the tank when the container is being pressurized and filled, and a third valve actuatable to connect the air return cannula to an evacuation circuit to execute the degassing of the container after the filling step.

These known isobaric filling machines also present the problem of being unsuitable for use to fill plastic containers, since the plastic container would be damaged during the pre-evacuation step, in which it would be crushed due to the considerable vacuum generated by the suction circuit, and during the filling step, in which the container is taken to the same high pressure as the tank.

PRESENTATION OF THE INVENTION

In this situation, the basic problem of the present invention is to prevent the problems occurring in the technique known up to now, providing a machine for filling containers with liquids and a process for filling containers with liquids which allow the filling of containers, particularly those made of plastic, controlling the suction from the air return cannula of each valve group, in a manner completely independent from the other valve groups.

Another purpose of the present invention is to provide a filling machine and a process for filling containers which allow the regulation of suction through the air return cannula between at least two levels for two different functionalities, in particular with simple opening and closing valves.

Another purpose of the present invention is to provide a filling machine and a process for filling containers which allow the regulation of the speed at which the liquid is delivered into the container.

Another purpose of the present invention is to provide a filling machine and a process for filling containers capable of precisely defining the filling liquid level in the containers.

Another purpose of the present invention is to provide a filling machine and a process for filling containers which prevent the residual liquid dripping from inside the air return cannula during the passage of the valve group from the exit station to the entrance station of said filling machine.

Another purpose of the present invention is to provide a filling machine capable of isolating the tank of the liquid to be bottled, avoiding any contamination of the atmosphere in the tank and of the liquid inside it.

BRIEF DESCRIPTION OF THE DRAWINGS

The technical characteristics of the finding, according to the above-mentioned purposes, are clearly seen in the content of the claims indicated below and its advantages will become more evident in the detailed description that follows, made with reference to the annexed drawings, which represent a purely exemplary and non-limiting embodiment, in which:

DETAILED DESCRIPTION OF A PREFERRED EXAMPLE OF EMBODIMENT

With reference to the annexed drawings, 1 is used to indicate the complete machine for filling containers with liquids according to the present invention.

It is destined for filling containers 2 with edible liquids, in particular with non-carbonated liquids, such as, in particular, still wines, spirits, liqueurs, fruit juices, etc.

The filling machine 1 in question is traditionally included in a bottling system or line equipped with several machines that work in succession, and is particularly positioned afterwards a rinsing machine and downwards a capping machine. The containers 2 are transferred from one machine to the other by means of transport lines, such as conveyor belts, or by means of transport equipment such as stars, worms, etc.

Figure 1:
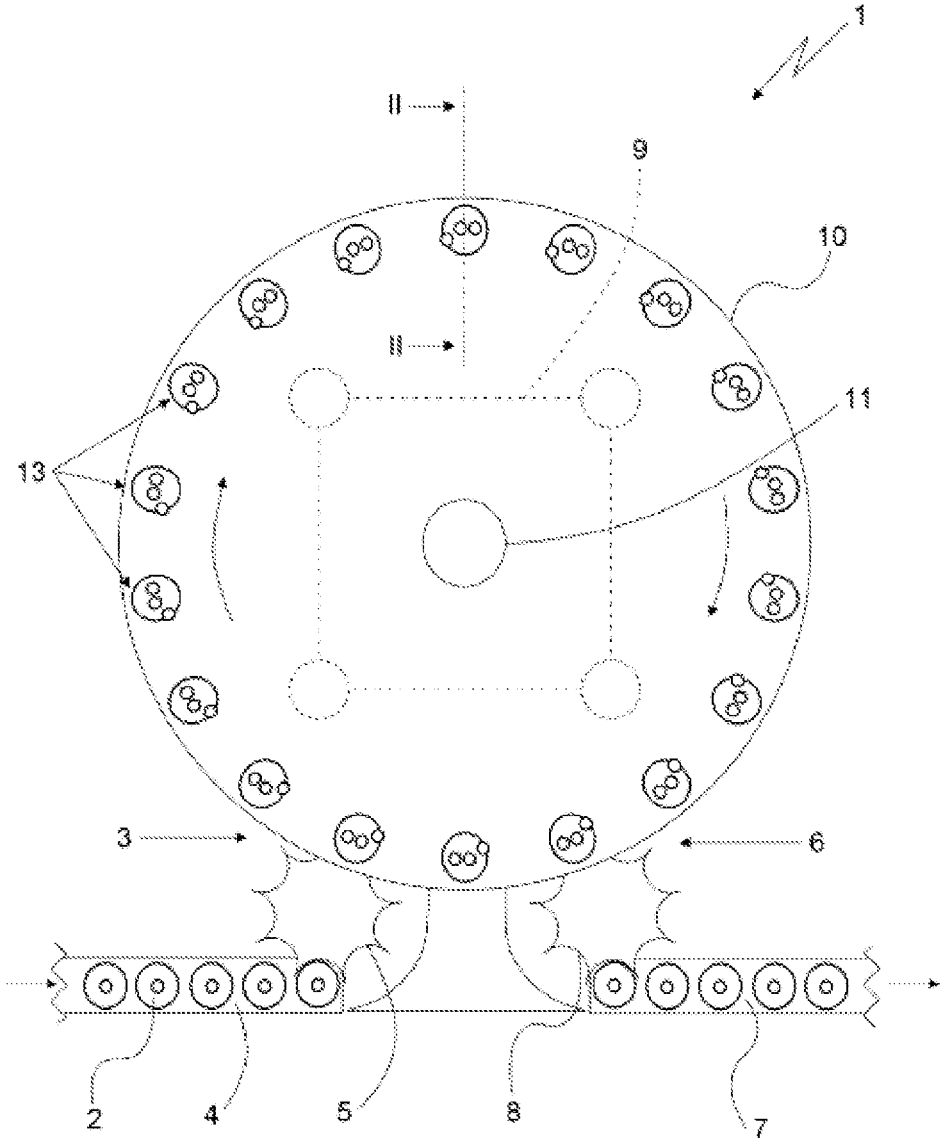
FIG. 1 shows a schematic plan view of the filling machine according to the present invention.

In more detail, with reference to the embodiment shown in FIG. 1, the filling machine 1 is conventionally equipped with an entrance station 3, in which it receives the containers 2 to be filled from a first transport line 4 (by means of a first star 5 for example), and with an exit station 6, in which the filled containers 2 are released to a second transport line 7 (by means of a second star 8 for example) to be channelled towards a machine downwards, such as a capping machine.

The filling machine 1 in question is equipped with a support structure 9 (indicated schematically using dashed lines in FIG. 1), onto which a rotatable carousel 10 is rotatably mounted around its own vertical rotation axis 11 by means of known motors means (not shown).

The rotatable carousel 10 is equipped with a tank 12, preferably ring-shaped, inside which the liquid to be bottled is contained. In particular, the tank 12 is filled with the liquid to be bottled up to a determined level, above which an inert gas (nitrogen for example) is introduced and kept substantially at atmospheric pressure, and preferably a slight overpressure with respect to the atmospheric pressure.

Furthermore, the rotatable carousel 10 carries a plurality of valve groups 13 peripherally mounted, evenly distributed along its circumference, and suitable to transfer the liquid from the tank 12 to the underlying containers 2 to be filled, said containers generally being glass or plastic bottles.

More in detail, each valve group 13 comprises a supply duct 14 hydraulically connected to the tank 12 for the flow of liquid from tank 12 to the underlying containers 2 to be filled, ending with a lower discharging lip 14'. Furthermore, there is a shutter 15 installed to intercept the supply duct 14 so as to regulate the flow of the liquid into said containers 2. Furthermore, each valve group 13 is equipped with an air return cannula 16 mounted parallel inside the supply duct 14, and equipped with an open lower end 16' susceptible to being inserted in the container 2 to hydraulically regulate the maximum liquid level in said container 2 during the filling of the latter, and with an upper end 16" opposite to the lower end 16', preferably positioned above a lid 12' of the tank 12. The air return cannula 16 is crossed by a gas and by a residual amount of liquid coming from the container 2 at least during a filling step and a step for defining the liquid level in the container 2, or during a step for cleaning the air return cannula 16, as will be described in detail hereto. In particular, the gas in the container 2 may comprise air, or an inert gas insufflated into the container 2 before and/or during the filling step of the container 2 according to operative steps known to the technician in the sector, or a mixture of air and inert gas.

Preferably, the filling machine 1 in question also comprises support means 17 mounted on the rotatable carousel 10, which are suitable to transport each container 2 below a corresponding valve group 13, and are movable between at least one lowered position, in which the container 2 is separated from the corresponding valve group 13, and a raised position, in which the container 2 is hydraulically associated with the corresponding valve group 13, with the mouth 2' of the container 2 brought into a sealing relationship with the supply duct 14 of the corresponding valve group 13 to fill the container 2.

More in detail, in the present description container 2 will be considered as separated from the corresponding valve group 13 when said container 2 is supported by support means 17 in any position in which the mouth 2' of the container is not in a sealing relationship with the supply duct 14 of the corresponding valve group 13, so that, in particular, the inside of the container 2 is in communication through the mouth 2' with the outside environment.

In particular, the support means 17 are actuatable to be moved between said raised position, in which they place the mouth 2' of the container 2 in a sealing relationship with the supply duct 14 of the corresponding valve group 13, and a minimum lowered position, in which they receive the container 2 when they transit in the entrance station 3 of the filling machine 1. Preferably, the support means 17 during the movement between said minimum lowered position and said raised position, take on intermediate lowered positions in which the mouth 2' of the container 2 is not sealed with the supply duct 14 of the corresponding valve group 13.

With reference to the embodiment shown in the annexed figures, the support means 17 of the containers 2 comprise a plurality of support plates 18 peripherally mounted on the rotatable carousel 10 under the corresponding valve groups 13 and destined to accept the containers 2 during their operative stroke on the rotatable carousel 10.

Preferably, during the rotation of the rotatable carousel 10, each support plate 18 is commanded to move between said lowered position and said raised position by means of a fixed cam 19, arranged around the rotatable carousel 10, and acting with its shaped profile on a cam follower 20 (consisting, for example, in an idle wheel) fastened to the corresponding support plate 18.

Advantageously, the support means 17, in order to transport plastic containers 2, can be equipped with pick-up forks 21, each of which is susceptible to grasping the corresponding plastic container 2, engaging the ring shaped ridge 2" which protrudes outside the neck of said container 2.

Figure 4:
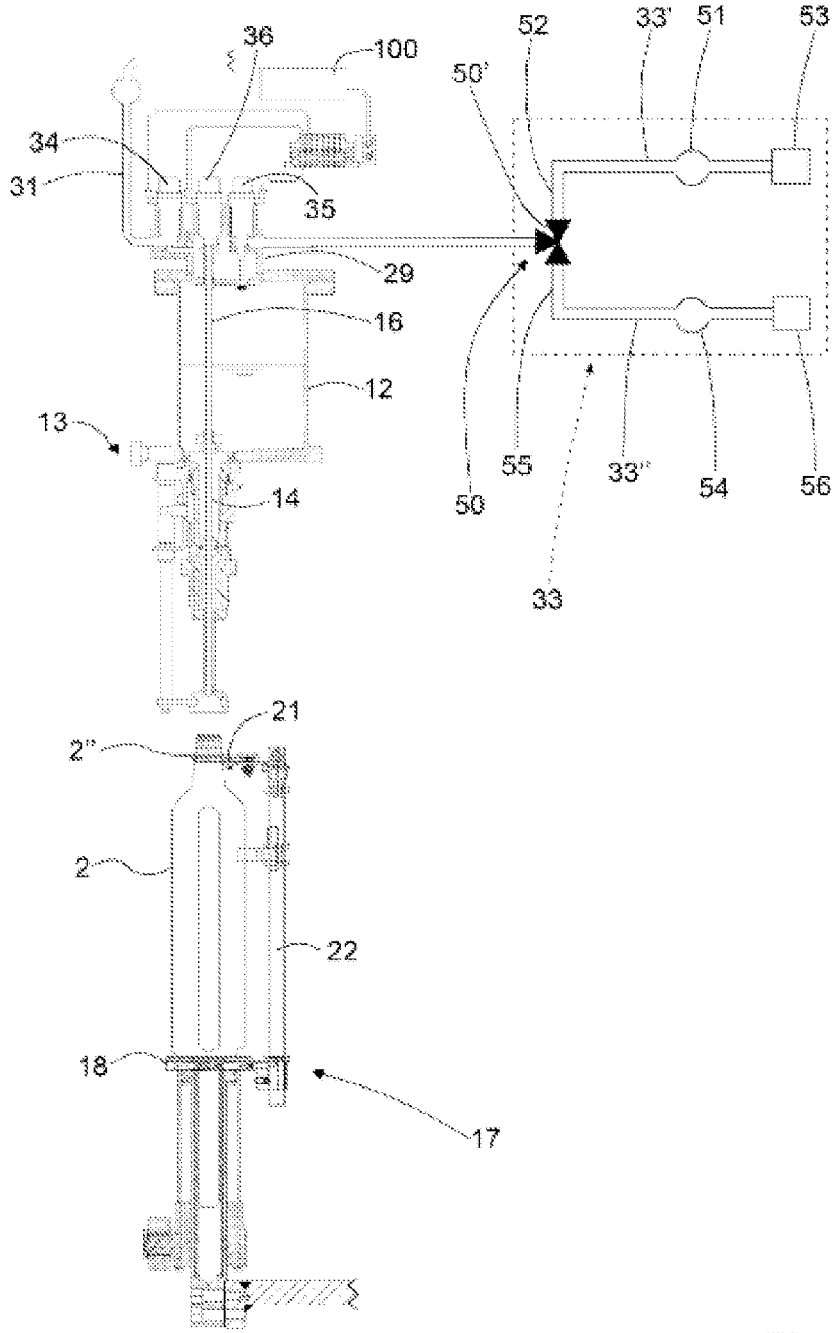
FIG. 4 shows a section view of the filling machine according to the present invention, in which the support means of the containers are prepared to support plastic containers.

In more detail, with reference to the embodiment shown in FIG. 4, each support plate 18 carries a corresponding above-mentioned pick-up fork 21 supported at least by a vertical support bar 22 and positioned at a height from the corresponding support plate 18 which is adjustable to suit the format and height of the plastic container 2 to be transported.

With reference to the embodiment shown in the annexed figures, each valve group 13 has a centering cone 23 to accept the mouth 2' of the container 2 raised by support means 17, and to consequently command, with its raising, the opening of the shutter 15 by means of an upward movement of a mobile sheath 24 mounted so that it may slide around the supply duct 14.

Preferably, the shutter 15 is fastened externally to the air return cannula 16 and is susceptible to rest against an internal ring protuberance 24' of the mobile sheath 24 to close the passage of the liquid. Operatively, the raising of the mobile sheath 24 of the valve group 13, commanded by the raising of the container 2, takes the internal ring protuberance 24' of the mobile sheath 24 to move away from the shutter 15, allowing in this way the opening of the passage of the liquid.

With reference to the embodiment shown in the annexed figures, the centering cone 23 of each valve group 13 is supported by one or more vertical posts 26 mounted so that they can slide on the corresponding valve group 13 to allow the raising of the centering cone 23 when it receives the mouth 2' of the container 2 raised by the support means 17.

Furthermore, the centering cone 23 has a central hole 27 aligned with the supply duct 14 of the corresponding valve group 13 to allow the flow of liquid into the container 2.

Advantageously, the centering cone 23 is equipped, in the central hole 27, with a sealing gasket 28, preferably ring shaped, and equipped with a lower surface to receive the mouth 2' of the container 2, and with an upper surface destined to touch the discharging lip 14' of the supply duct 14 when the container 2 is hydraulically associated with the valve group 13 by the support means 17 in a raised position, in order to place the mouth 2' of the container 2 in a sealing relationship with the supply duct 14 during the steps for filling and defining the liquid level in the container 2.

In accordance with the idea at the basis of the present invention, each valve group 13 comprises a collection cup 29, which is connected to the upper end 16" of the air return cannula 16 to receive the gas and the residual amount of liquid that cross said air return cannula 16 during the operative steps of the filling process described in detail hereto.

Furthermore, the collection cup 29 of each valve group 13 is connected, by means of a first connection duct 30 to an evacuation circuit 31, through which the gas from the container is evacuated while it is being filled, and is connected, by means of a second connection duct 32, to suction means 33 destined to be placed in communication with the collection cup 29 to depressurize the latter, as described in detail hereto.

Furthermore, according to the invention, each valve group 13 comprises a first control valve 34, to intercept the first connection duct 30, actuatable to switch between a first closed position, in which it blocks communication between the collection cup 29 and the evacuation circuit 31, and a first open position, in which it opens communication between the collection cup 29 and the evacuation circuit 31 to evacuate, towards the outside environment at atmospheric pressure, the gas from the container 2 during the filling step of the latter.

Furthermore, each valve group 13 comprises a second control valve 35, to intercept the second connection duct 32, and actuatable to switch between a second closed position, in which it blocks communication between the collection cup 29 and the suction means 33, and a second open position, in which it opens communication between the collection cup 29 and the suction means 33, which are suitable for to sucking the gas from the container 2 (during the filling of the latter), or for sucking inside the collection cup 29 the residual liquid present in the air return cannula 16 (during the cleaning step of the latter).

The filling machine 1 in question comprises, also, a logic control unit 100 (preferably comprising a PLC), which is operatively connected to the first and second control valves 34, 35 of each valve unit 13 to control the switching thereof.

Operatively, during the filling step of the containers 2, the logic control unit 100 controls the switching of the first control valve 34 and the second control valve 35 to control the communication of the collection cup 29 with the evacuation circuit 31 and with the suction means 33. In this way, it is possible to regulate the pressure in the collection cup 29 and therefore the pressure in the air return cannula 16 and in the container 2 to be filled, in order to regulate the speed at which the liquid flows into said container 2.

In particular, switching the second control valve 35 to the second open position, the collection cup is placed in communication with the suction means, which create a vacuum in the collection cup 29 and therefore also in the air return cannula 16 connected to the latter. Consequently, the air return cannula 16 sucks the gas from the container 2 generating a consequent vacuum in said container 2 which determines an increase in the speed at which the liquid flows from the tank 12 to the container 2, as described in detail hereto with reference to the operative steps of the filling process according to the present invention.

Operatively, during the step for cleaning the air return cannula 16, the logic control unit 100 commands, with the container 2 in the position separate from the corresponding valve group 13, the switching of the second control valve 35 to the second open position, to place the collection cup 29 in communication with the suction means 33, which suck the residual amount of liquid from the air return cannula into the collection cup 29.

Advantageously, the suction means 33 are operatively connected to the logic control unit 100 and are actuatable by the latter, with the second control valve 35 in the second open position to suck in at least two different levels of suction into the suction cup 29 of each valve group 13. In particular, the suction means 33 are actuatable by the logic control unit 100 to generate in the collection cup 29 selectively a first suction level to suck the residual amount of liquid from the return cannula 16 during the step for cleaning the latter, or a second suction level to suck the gas from the container 2 during the filling of the latter in order to increase the speed at which the liquid flows into said container 2.

Advantageously, the suction means 33 comprise a first suction circuit 33' to generate in the collection cup 29 said first suction level, by means of which the suction means 33 allow the suction inside said collection cup 29 of the residual amount of liquid remaining in the air return cannula 16, with the container 2 positioned separately from the corresponding valve group 13. Preferably, said first suction level is equal to about 70-80 millibar below the atmospheric pressure, in order to generate sufficiently strong suction to suck into the collection cup 29 the residual amount of liquid remaining in the air return cannula 16 after the step to define the liquid level.

Furthermore, the suction means 33 comprise a second suction circuit 33" to generate in the collection cup 29 a second suction level, below said first suction level, and by means of which the suction means 33 allows the suction of the gas contained inside the container 2 during the filling of the latter, with the container 2 hydraulically associated with the corresponding valve group 13 and with the shutter 15 open for the descent of the liquid into the container 2. Preferably, this second suction level is comprised substantially in the interval between 10 and 40 millibar below the atmospheric pressure, to avoid crushing plastic containers 2. In particular, the second suction level can be adjustably programmed, preferably by means of the logic control unit 100, depending on the type of liquid to be bottled and the type of containers 2 to be filled (for example depending on the resistance of the plastic containers to deformation).

The suction means 33 also comprise interception means 50 positioned between the second connection duct 32 of each valve group 13 and said first and second suction circuits 33', 33", and actuatable by the logical control unit 100 to place the second connection duct 32 of each valve group 13 selectively in communication with the first suction circuit 33' (during the step for cleaning the air return cannula 16) or with the second suction circuit 33" (during the step to fill the container 2).

In accordance with the embodiment shown in the annexed figures, the first suction circuit 33' comprises a first common manifold 51 of the filling machine 1 (advantageously ring shaped) connected to the second connection duct 32 of each valve group 13 by means of a corresponding first connection duct 52, and connected to a first source of suction 53 equipped with a first vacuum pump actuatable by the logic control unit 100 to generate said first suction level.

The second suction circuit 33" comprises a second common manifold 54 of the filling machine 1 (advantageously ring shaped) connected to the second connection duct 32 of each valve group 13 by means of a corresponding second connection duct 55, and connected to a second source of suction 56 equipped with a second vacuum pump actuatable by the logic control unit 100 to generate said second suction level, preferably in an adjustable manner.

Figure 2:
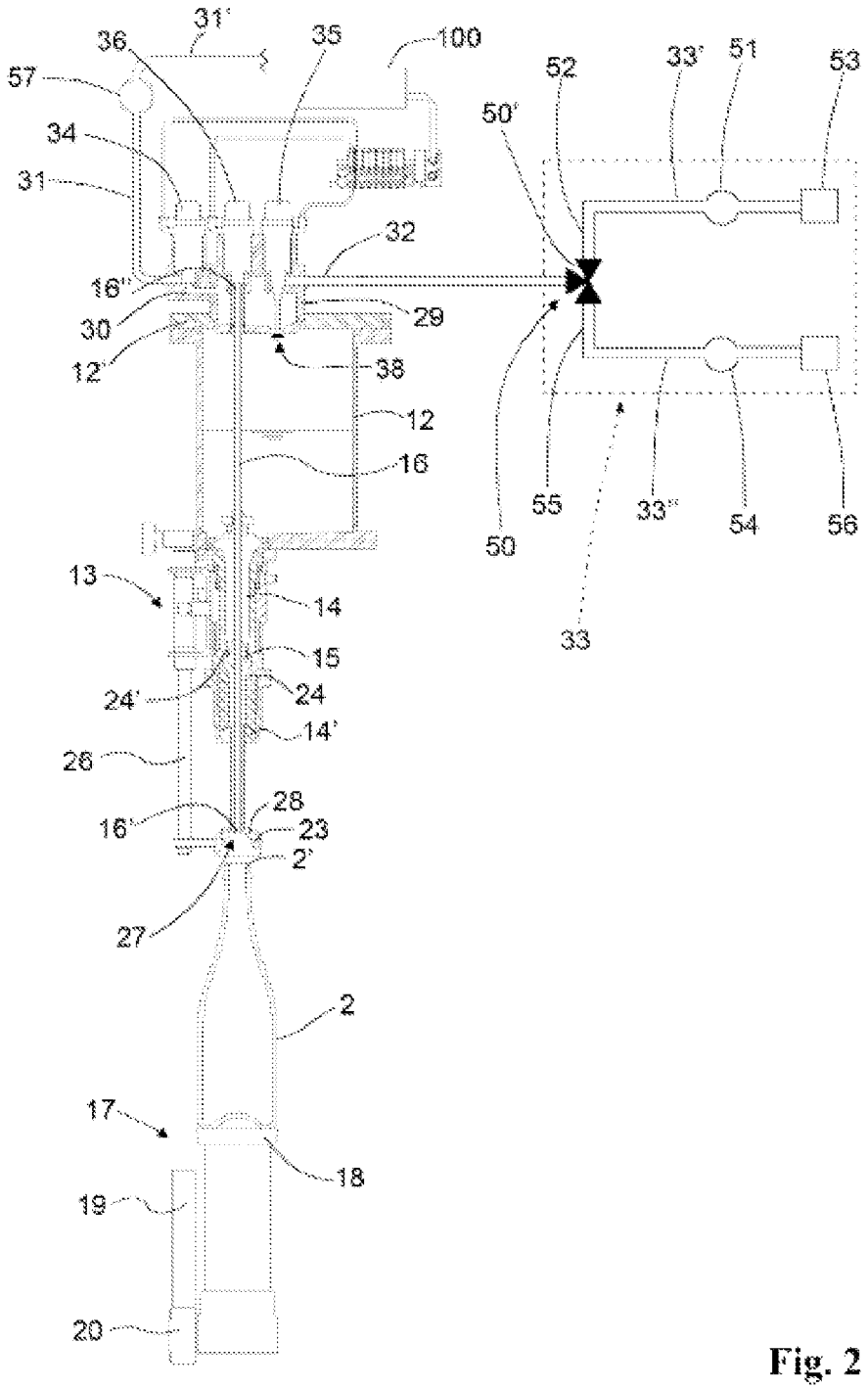
FIG. 2 shows a section view of the filling machine shown in FIG. 1 according to section line II-II of said FIG. 1.

In accordance with the embodiment shown in FIG. 2, the interception means 50 comprise a plurality of three-way valves 50', each of which is positioned to intercept the connection duct 32 of the corresponding valve group 13 and of the corresponding first and second connection ducts 52, 55 respectively of the first and second suction circuits 33', 33".

Each three-way valve 50' is operatively connected to the logic control unit 100 and is actuatable by the latter to selectively switch to a first operative position, in which it places the second connection duct 32 of the corresponding valve group 13 in communication with the first suction circuit 33', or in a second operative position, in which it places the second connection duct 32 of the corresponding valve group 13 in communication with the second suction circuit 33".

The suction means 33 to generate the two vacuum steps can obviously be obtained with a different hydraulic configuration from the preferential configuration described above, without leaving the scope of protection of the present patent.

In accordance with the embodiment shown in FIG. 2, the evacuation circuit 31 preferably comprises a third common manifold 57 of the filling machine (advantageously ring shaped) connected to the first connection duct 30 of each valve group 13, and connected by means of at least one tubular derivation 31' open to the environment outside the filling machine 1, preferably at atmospheric pressure, in which the gas coming from the containers 2 during their filling is expelled. In this way, the air present in the containers 2 is taken outside of the tank 12, preventing any contamination of the inert gas contained in said tank 12.

Advantageously, each valve unit 13 comprises a third control valve 36 to intercept the upper end 16" of the air return cannula 16, and actuatable by the logic control unit 100 to move between a third closed position, in which it obstructs the upper end 16" of the air return cannula 16, and a third open position, in which it is distanced from the upper end 16" of the air return cannula 16 to place the latter in communication with the collection cup 29.

In particular, the third control valve 36 allows the instant closure of the passage of the gas through the air return cannula 16 once the container 2 has been completely filled, subsequently allowing the closure of the first control valve 34 and the opening of the second control valve 35 without pressure changes in the collection cup 29 disturbing the pressure equilibrium that guarantees the correct level of filling inside the container 2.

Furthermore, advantageously, during the washing of the filling machine 1, the third control valve 36 allows the closure of the upper end 16" of the air return cannula 16 to prevent the washing liquid from coming out of the latter, thus preventing excessive waste of said washing liquid. Furthermore, with the third control valve 36, in the third closed position, it is possible to completely wash the inside of the collection cup 29, in particular the areas of the internal surface of the collection cup 29 positioned at a higher level than the upper end 16" of the air return cannula 16.

Advantageously, the collection cup 29 of each valve group 13 is equipped with a connection opening 37 positioned in communication between the collection cup 29 and the tank of the liquid to be bottled, and preferably positioned above the free surface of the liquid in the tank 12. This connection opening 37 makes it possible to bring the tank 12 into pressure equilibrium with the collection cup 29 and therefore with the container 2, particularly during the step to fill the latter and when defining the liquid level. Furthermore, said connection opening 37 makes it possible to return the residual amount of liquid remaining in the air return cannula 16 and sucked into the collection cup 29 by the suction means 33, into the tank 12.

Advantageously, each valve group 13 comprises a fourth control valve 38 which intercepts said connection opening 37 of the collection cup 29 to regulate the communication between the latter and the tank 12.

In more detail, the fourth control valve 38 is actuatable by the logic control unit 100 to move between a fourth closed position, in which it obstructs the connection opening 37, and a fourth open position, in which it is distanced from the connection opening 37 to place the collection cup 29 in communication with the tank 12.

In particular, the fourth control valve 38 is activated to move into the fourth closed position with the second control valve 35 in the second open position, in which the latter places the collection cup 29 in communication with the suction means 33 in order to prevent the suction means 33 from sucking the inert gas inside the tank 12 and to prevent any disturbance of the pressure inside said tank 12.

Preferably, the fourth control valve 38 is activated to move to the fourth open position when the first control valve 34 is in the first open position, to allow the pressure equilibrium between container 2 and tank 12 in the steps to fill container 2 and define the liquid level, as explained in detail hereto.

Advantageously, the fourth control valve 38 is activated by the second control valve 35, so that when the second control valve 35 is closed, the fourth control valve 38 is open, and vice versa. In more detail, when the second control valve 35 is activated by the logic control unit 100 to switch to the second open position, in turn it activates the fourth control valve 38 to switch to the fourth closed position, and when the second control valve 35 is activated to switch to the second closed position, in turn it activates the fourth control valve 38 to switch to the fourth open position.

In accordance with the embodiment shown in the annexed figures, the collection cup 29 of each valve group 13 is sealed onto the lid 12' of the tank 12 of the filling machine 1.

The collection cup is also advantageously equipped with a concave bottom portion 39, set at a lower level than the upper end 16" of the air return cannula 16, and fastened to the lid 12' of the tank 12. This bottom portion 39 is suitable for receiving the residual amount of liquid in the air return cannula 16 and sucked inside the collection cup 29 when the second control valve 35 places the latter in communication with the suction means 33.

Preferably, on the bottom portion 39 of the collection cup 29 there is said connection opening 37 between the collection cup 29 and the tank 12, to allow the channelling of the residual amount of liquid into the tank 12 by effect of the force of gravity alone.

Advantageously, the first connection duct 30, and preferably the second connection duct 32, which connect the collection cup 29 respectively with the evacuation circuit 31 and with the suction means 33, flow into the collection cup 29 at a level higher than that of the bottom portion 39 of the latter, in which the residual amount of liquid from the air return cannula 16 is collected, in order to prevent the channelling of said residual amount of liquid into the evacuation circuit 31, and preferably in order to avoid channelling the residual amount of liquid into the suction means 33.

Figure 3:
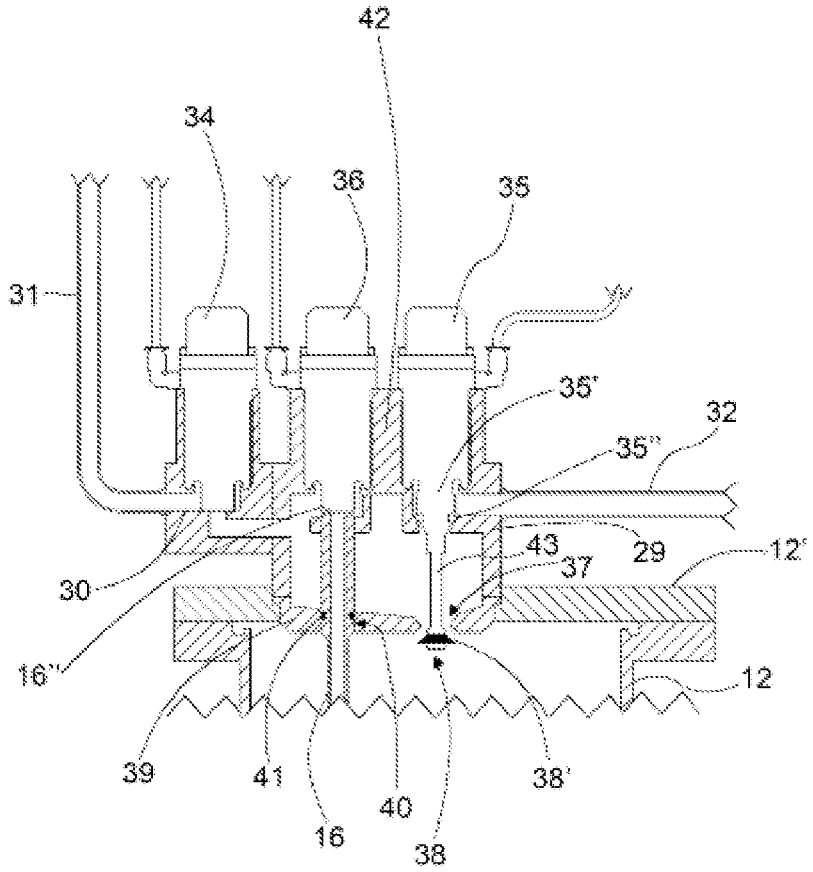
FIG. 3 shows a detail of the filling machine shown in FIG. 2 relating to a collection cup of a valve group.

With reference to the embodiment shown in FIG. 3, the air return cannula 16 is positioned with its upper end 16" inside the collection cup 29, and is preferably positioned through a hole 40 made in the bottom portion 39 of said collection cup 29. In particular, the air return cannula 16 is introduced in the through hole 40 in the bottom portion 39, and sealed using preferably a ring gasket 41.

The control valves 34, 35, 36 of each valve group 13 are preferably pneumatic, and are activated by means of the introduction of pressurized gas from a pressurized gas source (not shown) commanded by the logic control unit 100 of the filling machine 1.

Advantageously, the first and second control valves 34 and 35, and preferably the third control valve 36, of each valve group 13 are mounted on the collection cup 29. In particular, the second and third control valves 35 and 36 are fastened to an upper portion 42 of the collection cup 29 that closes the bottom portion 39 of the latter.

In particular, again with reference to FIG. 3, the second control valve 35 comprises a valve body 35' housed inside the second connection duct 32, which connects the collection cup 29 to the suction means 33. This valve body 35' is preferably equipped with a ring gasket 35" which, when the second control valve 35 is in the second closed position, is suitable to create a seal with a groove on the second connection duct 32 to block communication between the collection cup 29 and the suction means 33.

In particular, the fourth control valve 38, which intercepts the connection opening 37 between the collection cup 29 and the tank 12, comprises an intercepting body 38' fastened by means of a connection portion 43, preferably in the shape of a rod, to the valve body 35' of the second control valve 35. Said interception body 38' of the fourth control valve 38 is actuatable by the second control valve 35 to move between the fourth closed position, with the second control valve 35 in the second open position, and the fourth open position, with the second control valve 35 in the second closed position, so that the collection cup 29 is selectively connected either to the suction means 33 or to the tank 12.

According to the characteristics of the present invention, the collection cup 29 of each valve group 13 is isolated from the collection cups 29 of the other valve groups 13 of the filling machine 1, and is independently placed in communication with the evacuation circuit 31 and the suction means 33 through the respective switching of the first and second control valves 34, 35 of the corresponding valve group 13.

In this way, the filling machine 1 in the present invention allows the control of the suction of the air in each single valve group 13 independently from the other valve groups 13 of said filling machine 1.

This particularly allows the actuation of the cleaning of the air return cannula 16 of each valve group 13 only when the container 2 is in the separate position from the corresponding valve group 13, independently of the operative steps in progress on the other valve groups 13 of the filling machine 1.

In accordance with another embodiment not shown in the annexed figures, each valve group 13 is equipped with an insufflation cannula inserted inside the air return cannula 16, through which inert gas, preferably nitrogen, is introduced into the container 2 to reduce the amount of oxygen inside it. To this end, the insufflation cannula is connected to an inert gas supply circuit by means of a third connection duct passing inside the collection cup 29 of the corresponding valve group 13 and intercepted by a fifth control valve. The latter is actuatable by the logic control unit 100 to switch between a fifth closed position, in which it obstructs the third connection duct, and a fifth open position, in which it places the insufflation cannula in communication with the inert gas supply circuit to introduce said inert gas into the container 2, particularly before the filling step of the latter.

This subject of the present invention is also a process for filling containers, achieved in particular using the filling machine 1 of the type described above.

To simplify the explanation, reference will be hereto be made to the same nomenclature used so far, although it must be intended that the present procedure can also be achieved with filling machines that are not equipped with all the features considered above.

Figures 5A, 5B, 5C, 5D, 5E:
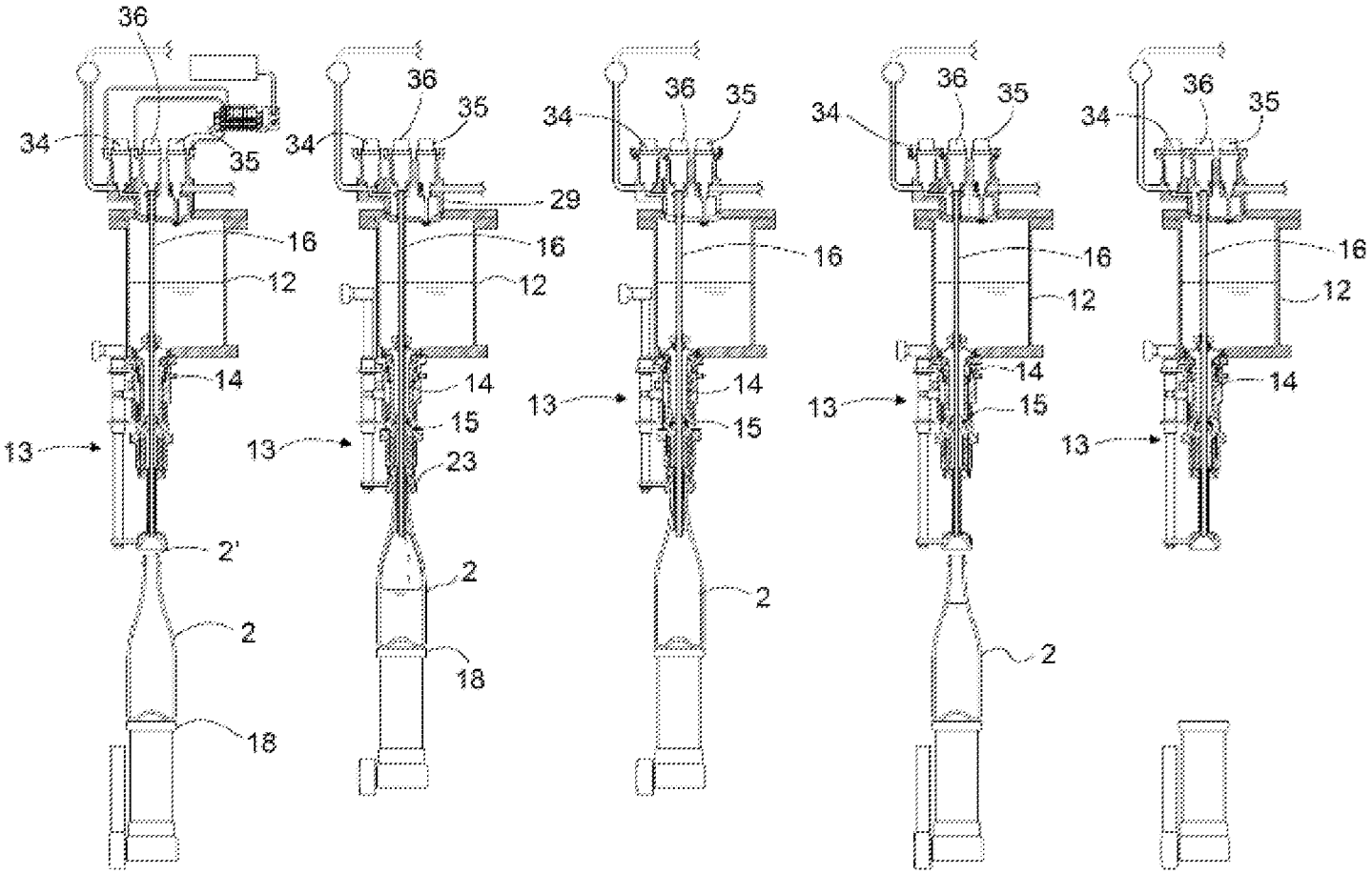
FIGS. 5*a*-5*e* show one of the valve groups of the filling machine in different operative steps of the filling process according to the present invention.

The process to fill the containers according to the present invention preferably comprises an initial stage of entry of the container 2 to be filled into the filling machine 1, in which the container 2 coming from the first transport line 4 is carried, by the first star 5, to the entrance station 3 of said filling machine 1 and is deposited on the support means 17 in their minimum lowered position, as shown in the embodiment in FIG. 5*a*.

Subsequently, provision is made for a step for lifting the container 2, in which the latter is hydraulically associated with the corresponding valve group 13 by means of the support means 17, with the mouth 2' of the container 2 which is brought into a sealing relationship with the supply duct 14 of the corresponding valve group 13.

In particular, in said lifting step the support plate 18 of the support means 17, which transports the corresponding container 2 in its operative stroke on the rotatable carousel 10, is commanded by the fixed cam 19 to move from its lowered position to its raised position, in which it takes the mouth 2' of the container 2 into a sealing relationship with the supply duct 14. In more detail, preferably the container 2, while it is being lifted, moves into contact with the centering cone 23 of the corresponding valve group 13, and the centering cone 23 is then raised until it comes into contact with the discharging lip 14' of the supply duct 14.

The filling process in question also comprises a step for filling the container 2 hydraulically associated with the corresponding valve group 13, in which the liquid is delivered from the tank 12 into said container 2 through the opening of the shutter 15, and in which the gas contained in the container 2 comes out of the latter through the air return cannula 16 following the entrance of the liquid delivered into the container 2, as shown in the embodiment in FIG. 5*b*.

In more detail, preferably the opening of the shutter 15 is activated by the upward movement of the mobile sheath 24 of the valve group 13, activated in turn by the raising of the container 2 after the movement of the support means 17 to the raised position.

Furthermore, provision is made for a step to define the liquid level in the container 2, in which the liquid delivered into the container 2 reaches the lower end 16' of the air return cannula 16, obstructing it, and a residual amount of liquid rises inside said air return cannula 16, as shown in the embodiment in FIG. 5*c*.

In more detail, when the liquid delivered into the container 2 obstructs the lower end 16' of the air return cannula 16, it interrupts the exit of the gas from the container 2, since the seal of the mouth 2' of the latter with the supply duct 14 prevents any other exit of the gas from said container 2. The compression of said gas in the container 2 prevents the liquid from rising further in said container 2, and the residual amount of liquid rises instead inside the air return cannula 16 until it substantially reaches the same level as the liquid in the tank 12 according to the known principle of communicating vessels, consequently determining the interruption of delivery of liquid into the container 2.

A closure step of the shutter 15 is then provided for, with a lowering step of the filled container 2, in which the latter is placed in the separate position from the corresponding valve group 13, via the movement of the support means 17 from the raised position to the lowered position, as shown in the embodiment in FIG. 5*d*.

Preferably, the closure of the shutter 15 is determined by the lowering of the mobile sheath 24 of the valve group 13, determined by the lowering of the container 2, filled, following the movement of the support means 17 from the raised position to the lowered position.

Subsequently, a step is preferably provided for in which the filled contained 2 leaves the exist station 6 of the filling machine 1, and in which the container 2 is picked up from the support means 17 by the second star 8 and is placed on the second transport line 7 to be channelled to the operating machine ahead.

In accordance with the idea at the basis of the present invention, the process for filling containers with liquids in question comprises, after the filling and level definition steps, a step for cleaning the air return cannula 16, in which the residual amount of liquid contained in the air return cannula 16, is sucked into the collection cup 29.

In more detail, in this cleaning step, the logic control unit 100 commands the switching of the second control valve 35 to its second open position, to place the collection cup 29 in communication with the suction means 33, and preferably commands the first control valve 34 in the first closed position to isolate the collection cup 29 from the evacuation circuit 31, as shown in the embodiment in FIG. 5*e*. Following the vacuum generated by the suction means 33 in the collection cup 29, the residual amount of liquid present in the air return cannula 16 is sucked into the collection cup 29. This cleaning step is executed when the container 2 is placed in the position separate from the corresponding valve group 13, that is when the mouth 2' of the container 2 is not sealed with the supply duct 14, to prevent the suction generated by the suction means damaging the container 2.

In particular, the cleaning step of the air return cannula 16 is executed during a specific moment in the operative stroke of the vale group 13 positioned on the rotatable carousel 10, comprised between a first angular position of the first valve group 13, in which the filled container 2 is separated from the valve group 13 and a second angular position of the valve group 13, in which a subsequent container 2 to be filled is hydraulically associated with the valve group 13.

In this way, the suction of the residual amount of liquid in the air return cannula 16, provided for in the cleaning step, is executed after the filled container 2 has been separated from the corresponding valve group 13 in said step to lower the filled container 2 and before the next container 2 to be filled is hydraulically associated with the corresponding valve group 13 in said step to lift the container 2 to be filled.

Preferably, the step to clean the air return cannula 16 is executed during said operative stroke of the valve group 13 in the passage of the latter substantially from the exit station 6 to the entrance station 3 of the filling machine 1.

The process according to the invention particular provides for the suction of the residual amount of liquid from the air return cannula 16, provided for during the cleaning step, to be executed only when the container 2 is in the separate position from the corresponding valve group 13.

The execution of the air return cannula 16 cleaning step with the container 2 in the separate position from the valve group 13 advantageously allows the cleaning of the air return cannula 16 without crushing the container 2. In fact, the gas sucked from the container 2 into the air return cannula 16 following the suction of the residual amount of liquid, is offset by the entrance of air through the mouth 2' of the container 2 which is in communication with the outside environment, without therefore creating any damaging vacuum inside the container 2.

Furthermore, following the cleaning step according to the invention, in the next filling cycle, the air return cannula 16 is completely free from any residual amount of liquid and therefore the delivery of the liquid into the container 2 to be filled starts immediately with the opening of the shutter 15, allowing the extremely swift execution of the filling step with a consequent high production capacity of the filling machine 1.

Advantageously, in the cleaning step the suction means 33 generate in the collection cup 29 a first suction level, equal to about 70-80 millibar below the atmospheric pressure, to determine a suction that is strong enough to suck back into said collection cup 29 the residual amount of liquid in the air return cannula 16.

In particular, this first suction level is obtained, during the cleaning step, by placing the second connection duct 32 of the collection cup 29 of the valve group 13 in communication with the first suction circuit 33' of the suction means 33, though the activation of the interception means 50 commanded by the logic control unit 100 of the filling machine 1.

In accordance with the embodiment shown in the annexed figures, during the cleaning step the three-way valve 50' (which intercepts the connection duct 32 of the corresponding valve group 13 and of the corresponding first and second connection ducts 52, 55 respectively of the first and second suction circuits 33', 33") is commanded by the local control unit 100 in the first operative position, in which the three-way valve 50' places the second connection duct 32 of the corresponding valve group 13 in communication with the first suction circuit 33', so that the latter generates said first suction level inside the collection cup 29.

In accordance with a particular feature of the process in the present invention, the filling step of the container 2 comprises an initial stage of evacuation of the gas (from the container 2) through the evacuation circuit 31 connected to the outside environment at atmospheric pressure. In more detail, in this initial evacuation stage, the collection cup 29 is placed in communication with the evacuation circuit 31, through the switching of the first control valve 34 to the first open position, and is isolated from the suction means 33 via the switching of the second control valve 35 to the second closed position, as shown in the embodiment in FIG. 5*b*.

Preferably, the upper end 16" of the air return cannula is opened by the switching of the third control valve 36 to its third open position, in order to connect the air return cannula 16 to the collection cup 29.

Advantageously, the first and third control valves 34 and 36 are switched respectively to their first and third open positions before the container 2 is hydraulically associated with the valve group 13, particularly during the raising step of said container 2, so that it is possible to start the filling step as soon as the shutter 15 is open.

Advantageously, in said initial evacuation stage, the suction cup 29 is placed in communication with the tank 12, through said connection opening 37 of said suction cup 29, to bring the tank 12 into pressure equilibrium with the container 2. In particular, the communication between the suction cup 29 and the tank 12 is achieved by placing the fourth control valve 38 in its fourth open position.

Advantageously, the fourth control valve 38 is activated to switch to its fourth open position before the container 2 is hydraulically associated with the valve group 13 and preferably before switching the third control valve 36 to its third open position, to bring the inside of the suction cup 29, into a pressure equilibrium with the tank 12 before starting the filling step. In this way, the opening of the third control valve 36 makes it possible to substantially place the container 2 immediately into pressure equilibrium with the tank 12, with virtually zero waiting time before starting the filling step.

Advantageously, after said initial evacuation stage, the filling step comprises a stage of suction of the gas from the container 2 to create in the latter a determined vacuum in order to increase the delivery speed of the liquid into said container 2.

In more detail, during this suction stage, the collection cup 29 is placed in communication with the suction means 33, via the switching of the second control valve 35 to the second open position. Consequently, the air return cannula 16 (connected to the collection cup 29 depressurized by the suction means 33) sucks the gas from the container 2 and consequently determines a negative difference in pressure between the container 2 and the tank 12. This implicates a suction of the liquid from the supply duct 14, with the consequent increase in speed of the flow of liquid into the container 2, with respect to the evacuation stage in which the collection cup 29 is in communication with the evacuation circuit 31 at atmospheric pressure only.

Advantageously, in this suction stage of the filling step the suction means 33 generate in the suction cup at least a second suction level, lower than the first suction level which is generated during the cleaning of the air return cannula 16. Said second suction level can be preferably set so that it can be regulated between about 10 and 40 millibar below the atmospheric pressure and makes it possible to create a vacuum inside a plastic container 2 without crushing it.

In this way it is possible to increase the filling speed of the plastic container 2 without any risk of damaging them, in that the possibility of creating any damaging excessive vacuum in the container 2 is eliminated.

Furthermore, advantageously, the creation of disturbances inside the container 2 which might form considerable amounts of froth in the liquid delivered into said container 2 is avoided.

Preferably, in the suction stage the collection cup 29 is isolated from the evacuation circuit 31 by the first control valve 34 commanded in its first closed position by the logic control unit 100 of the filling machine 1.

In particular, the second suction level, during the suction stage of the filling step, is achieved by placing the second connection duct 32 of the collection cup 29 of the valve group 13 in communication with the second suction circuit 33" of the suction means 33, via the activation of the interception means 50 commanded by the logic control unit of the filling machine 1.

In accordance with the embodiment shown in the annexed figures, in the suction stage the three-way valve 50' of the valve group 13 is commanded by the logic control unit 100 in the second operative position, in which it places in communication the second connection duct 32 of the corresponding valve group 13 with the second suction circuit 33", so that the latter generates said second suction level inside the collection cup 29.

The achievement of the two levels of suction (the first in the cleaning step of the air return cannula 16 and the second in the suction stage of the filling step) via the connection of the collection cup 29 selectively with the first or the second suction circuit 33', 33" allows extremely precise definition of the suction level in each operative step and also allows rapid suction intervention time, particularly employing suction sources 53, 56 with two corresponding degrees of preset vacuum, and open/closed type valves 34, 35, 36, 50' as opposed to the variable opening type.

In accordance with a variant of the process in question, the second suction level, during the suction stage, is achieved by placing the collection cup 29 in communication also with the evacuation circuit 31, as well as the suction means 33.

In more detail, in accordance with the latter variant of the process in question, during the suction stage of the filling step of the container 2, the logic control unit 100 controls both the switching of the first control valve 34 to the first open position, to place the collection cup 29 in communication with the evacuation circuit 31, and the switching of the second control valve 35 to the second open position, to place the collection cup 29 in communication with the suction means 33. Consequently, the air return cannula 16 sucks the gas contained in the container 2 hydraulically associated with the valve group 13, being connected to the collection cup 29 depressurized by suction through the suction means 33 and through the opening towards the outside environment determined by the evacuation circuit 31.

The speed at which the liquid flows into the container 2 is faster than if the air return cannula were to be connected only to the outside environment, due to the vacuum created in the collection cup 29 and therefore in the air return cannula 16 by the suction means 33. At the same time, the vacuum of the suction means 33 is only partly transferred to the air return cannula 16 due to the presence of the opening of the evacuation circuit 31.

In accordance with the latter variant of the filling process in question, it is possible to connect the suction cup 29 to a single suction circuit with a substantially constant degree of vacuum (depressurization), with said degree of vacuum (preferably equal to 70-80 millibar below the atmospheric pressure) can be used entirely to suck the residual amount of liquid remaining in the air return cannula 16 from said cannula 16, and only partially used (in that it is reduced by the opening of the evacuation circuit 31) for the filling step of container 2 in order to increase the descent of the liquid into said container 2 with a reduced vacuum.

Advantageously, in accordance with any of the variants of the process in the present invention, in the suction stage of the filling step, the collection cup 29 is isolated from the tank 12, obstructing the communication opening 37 by switching the fourth control valve 38 to the fourth closed position, to prevent the suction means 33 from sucking the inert gas present in the tank 12, disturbing the internal pressure.

Advantageously, the filling step comprises, after the suction stage, a final gas evacuation stage (from container 2) through the evacuation circuit 31. In this final evacuation stage, like that provided for in said initial evacuation stage, the collection cup 29 is placed in communication with the evacuation circuit 31 via the first control valve 34 commanded in the first open position, and the collection cup 29 is isolated from the suction means 33 by the second control valve 35 commanded in the second closed position.

Also advantageously, during said final evacuation stage, the collection cup 29 is placed in communication with the tank 12 through the connection opening 37 of said collection cup 29 (particularly through the switching of the fourth control valve 38 to the fourth open position) to place the tank 12 in a pressure equilibrium with the container 2, before the liquid delivered into the latter reaches the lower end 16' of the air return cannula in the subsequent step for defining the liquid level in the container 2.

Advantageously, the step for defining the liquid level in the container 2 takes place at the end of said final evacuation stage, so that the pressure equilibrium between the container 2 and the tank 12 are also maintained during said level definition step.

In this way, it is assured that the liquid level stops precisely at the level defined by the lower end 16' of the air return cannula 16, in that, having taken the inside of the container 2 to the same pressure as the tank 12, the presence of any residual vacuum in the area of the head of said container 2 is avoided, thus preventing the liquid from rising inside the container 2 above the lower end 16' of the air return cannula 16.

Furthermore, as the lower end 16' of the air return cannula 16 is equipped with a hole on the side, the equilibrium between the container 2 and tank 12 ensure that the liquid stops level with the upper edge of the hole (with a maximum precision margin of about 1 mm), preventing the liquid from rising inside the cannula 16 through the hole before reaching said upper edge as would happen if their was still suction from cannula 16.

Advantageously, the process according to the present invention makes it possible, during the filling and level definition steps, to evacuate outside the tank 12 of the filling machine 1 the gas present in the container 2 and replaced by the liquid delivered into said container 2, thus preventing any contamination of the inert gas and the liquid contained in the tank 12.

After completing the step to define the liquid level in the container 2, the third control valve 36 is commanded to switch to its third closed position to block communication between the upper end 16" of the air return cannula 16 and the collection cup 29. Immediately afterwards, preferably, the first control valve 34 is commanded to switch to its first closed position to block communication between the evacuation circuit 31 and the collection cup 29. Subsequently, the lowering step of the filled container 2 is executed, in which the latter is placed in the separate position from the corresponding valve group 13.

As mentioned earlier, after the filling and level definition steps, provision is made for said air return cannula 16 cleaning step, in which the collection cup 29 is placed in communication with the suction means 33 to suck the residual amount of liquid in the air return cannula 16 inside it following the filling and level definition steps.

Preferably, the cleaning step provides for the opening of the upper end 16" of the latter, to place the air return cannula 16 in communication with the suction cup 29, after the mouth 2' of the filled container 2 has been separated from the supply duct 14 of the corresponding valve group 13 in said filled container 2 lowering step, and therefore when the mouth 2' of the container 2 is no longer in a sealing relationship with the supply duct 14.

The suction of the liquid from the air return cannula 16 is preferably completed by closing the upper end 16" of the latter, before the mouth 2' of the next container 2 to be filled is brought into a sealing relationship with the supply duct 14 of the corresponding valve group 13 in the subsequent lifting step of the container 2 to be filled.

Advantageously the opening and closing of the upper end 16" of the air return cannula 16 is achieved by the switching of the third control valve 36 respectively to the third open position and the third closed position.

Advantageously, the process for filling containers with liquids in question comprises a depressurization step of the collection cup 29 before the cleaning step, in order to suck the residual amount of liquid present in the air return cannula 16 immediately after separation of the filled container 2 from the corresponding valve group 13.

In this way, advantageously, any dripping of liquid from the air return cannula 16 during the passage of the valve group 13 from the exit station 6 to the entrance station 3 of the filling machine 1 is prevented, ensuring extreme cleanliness of said filling machine 1.

The depressurization of the collection cup 29 starts preferably after closure of the upper end 16" of the air return cannula 16, at the end of said step to define the liquid level in the container 2.

This depressurization step is achieved by placing the collection cup 29 in communication with the suction means 33 by the switching of the second control valve 35 to the second open position. Furthermore, the collection cup 29 is kept isolated from the evacuation circuit 31, with the first control valve 34 in the first closed position, and the upper end 16" of the air return cannula 16 is kept closed with the position of the third control valve 36 in the third closed position.

In this way, the second control valve 35 in its second open position places the collection cup 29 in communication with the suction means 33, which place said collection cup 29 in a vacuum before starting the cleaning step.

Then, after the container 2 has been separated from the valve group 13 in said lowering step, the switching of the third control valve 36 to its third open position is commanded to place the collection cup 29 in communication with the air return cannula 16, in order to suck out from the latter the residual amount of liquid, in accordance with said cleaning step.

Advantageously, the cleaning step of the air return cannula 16 and preferably also the depressurization step of the collection cup 29, provide for the closure of the connection opening 37 between the tank 12 and the collection cup 29 to isolate the latter from said tank 12, as shown in the embodiment in FIG. 5*e*. This prevents the suction means 33, in communication with the suction cup 29 via the second control valve 35 in the second open position, from sucking gas from the tank 12, and therefore allowing maintenance of the latter constantly at the internal pressure required.

In particular, the connection opening 37 is closed, controlling the above-mentioned fourth control valve 38 of the valve group 13 to switch to its fourth closed position.

Preferably, said operative steps of the process in question make it possible to place the collection cup 29 of each valve group 13 in communication selectively with the tank 12 or with the suction means 33, to prevent the latter from disturbing the pressure inside said tank 12. Preferably, said selective communication is achieved by controlling the switching of the second and fourth control valves 35 and 38 so that the second control valve 35 is switched to its second open position and the fourth control valve 38 is switched to its fourth closed position, and vice versa.

After completing the cleaning step, an advantageous step is provided for to drain the liquid from the collection cup 29, in which the latter is placed communication with the tank 12 through the connection opening 37, particularly switching the fourth control valve 38 to the fourth open position, to channel the liquid previously sucked into the collection cup 29 during the cleaning step into the tank 12. Preferably, in this draining step, the collection cup 29 is isolated from the suction means 33 and placed in communication with the evacuation circuit 31, to bring the inside of the collection cup 29 to atmospheric pressure without creating differences in pressure in the tank 12.

Advantageously, this liquid drainage step can be executed, in addition or alternative, in the subsequent execution of the process to fill another container, during the evacuation stage (initial and/or final) of the filling step, or during the step to define the liquid level in the container. In this way, particularly, sufficient time is guaranteed so that any froth that forms in the collection cup 29 returns to the liquid state and is therefore channelled into the tank 12 through the connection opening 37, guaranteeing the complete drainage from the collection cup 29 also of liquids subject to forming large amounts of foam.

Advantageously, the process for filling containers with liquids in question comprises at least one insufflation of inert gas into the container 2 to reduce the amount of oxygen in said container.

Preferably, the insufflation of inert gas takes place before the filling step, particularly before the container is hydraulically associated with the valve group 13, so that the oxygen present in the container 2 is replaced with inert gas, such as nitrogen, to prevent effects on the organoleptic characteristics of bottled liquids susceptible to oxidation, particularly wines.

Advantageously, when the filling machine is resting, and not operative, the first, second and third control valves, 34, 35 and 36 are taken respectively to their first, second and third closed positions, to completely isolate the tank 12 of the filling machine 1 from the outside environment, preventing any contamination of the liquid and inert gas contained in it.

The invention conceived thus achieves therefore the aims set.

The invention claimed is:

1. Machine for filling containers with liquids, which comprises:

a support structure;

a rotatable carousel rotatably mounted on said support structure, and equipped with a tank for containing a liquid to be bottled in containers;

a plurality of valve groups peripherally mounted on said rotatable carousel, each group comprising:

a supply duct hydraulically connected to said tank for the flow of said liquid from said tank to said containers to be filled;

a shutter placed to intercept said supply duct in order to regulate the flow of said liquid into said containers;

an air return cannula mounted parallel inside said supply duct, and equipped with a lower end susceptible to being inserted in said container, and an upper end opposite said lower end;

said filler machine being characterized in that each said valve group comprises:

an evacuation circuit;

a suction apparatus;

a collection cup, wherein the collection cup is connected to the upper end of said air return cannula, is connected to the evacuation circuit by a first connection duct, and is connected to the suction apparatus by a second connection duct;

a first control valve placed to intercept said first connection duct, and actuatable to switch between a first closed position, in which it blocks the communication between said collection cup and said evacuation circuit, and a first open position, in which it opens the communication between said collection cup and said evacuation circuit;

a second control valve placed to intercept said second connection duct, and actuatable to switch between a second closed position, in which it blocks the communication between said collection cup and said suction means, and a second open position, in which it opens the communication between said collection cup and said suction means;

said filler machine also comprising at least one logic control unit, which is operatively connected to said first and said second control valve of each valve group, and commands the switching of said first and second control valves;

wherein the collection cup of each valve group is equipped with a connection opening placed in direct communication between said collection cup and said tank, each valve group comprising:

a third control valve, placed to intercept the upper end of said air return cannula, and actuatable to be moved between a third closed position, in which the third control valve obstructs the upper end of said air return cannula, and a third open position in which the third control valve is spaced from said upper end in order to place said air return cannula in communication with said collection cup; and a fourth control valve that is placed to intercept said connection opening, the fourth control valve being movable between a fourth closed position and a fourth open position, wherein the fourth control valve obstructs said connection opening in the fourth closed position such that the collection cup and the tank are no longer in communication, and the fourth control valve is spaced from said connection opening and places said collection cup in direct communication with said tank in the fourth open position, and wherein said fourth control valve is in the fourth closed position at the beginning of the filling of said container and remains in the fourth closed position during a major portion of the filling of said container and said fourth control valve is in the fourth open position during the non-filling stage of said container and during the filling of said container following the major portion of the filling of said container, and wherein the fourth open position allows to drain into the tank the liquid previously sucked into the collection cup during a cleaning step of the air return cannula or to bring the tank into pressure equilibrium with the collection cup.

2. Machine for filling containers with liquids according to claim 1, characterized in that said suction means are operatively connected to said logic control unit and are actuatable by the latter in order to suck at at least two different suction levels in the collection cup of said valve group, with said second control valve in said second open position.

3. Machine for filling containers with liquids according to claim 2, characterized in that it also comprises support means mounted on said rotatable carousel, and movable between at least one lowered position, in which said container is in at least one position separated from a corresponding valve group, and one raised position, in which said container is hydraulically associated with said corresponding valve group with the mouth of said container placed in a sealing relationship with the supply duct of said corresponding valve group in order to execute the filling of said container;

said suction means comprising:

a first suction circuit adapted to generate a first suction level for sucking, inside said collection cup, a residual amount of liquid left in said air return cannula, with said container in said position separated from said corresponding valve group;

a second suction circuit adapted to generate a second suction level, lower than said first suction level, in order to suck a gas contained in said container, with said container hydraulically associated with said corresponding valve group and with said shutter open for the descent of said liquid into said container;

interception means placed between the second connection duct of each valve group and said first and second suction circuits, and actuatable by said logic control unit to selectively place each said second connection duct in communication with said first suction circuit or with said second suction circuit.

4. Machine for filling containers with liquids according to claim 1, characterized in that said first and second control valve are mounted on said collection cup.

5. Machine for filling containers with liquids according to claim 1, characterized in that said collection cup is equipped with a concave bottom portion placed substantially at a lower level at the upper end of said air return cannula, and sealingly fixed on a cover of said tank.

* * * * *